United States Patent [19]

Curry et al.

[11] 4,074,959

[45] Feb. 21, 1978

[54] APPARATUS FOR FORMING MULTI-PLY FIBROUS SHEETS

[75] Inventors: Harold George Curry, Hambrook; Brian William Attwood, Hanham near Bristol; Derek Graham Walter White, Bristol, all of England

[73] Assignee: Karl Kroyer St. Anne's Limited, Bristol, England

[21] Appl. No.: 728,282

[22] Filed: Sept. 30, 1976

Related U.S. Application Data

[60] Continuation of Ser. No. 489,053, July 16, 1974, abandoned, which is a division of Ser. No. 390,244, Aug. 21, 1973, Pat. No. 3,905,864.

[30] Foreign Application Priority Data

Sept. 9, 1972 United Kingdom ..... 41960/72

[51] Int. Cl.[2] ..... B29J 5/00

[52] U.S. Cl. ..... 425/81.1; 425/83.1; 264/113; 162/203

[58] Field of Search ..... 425/80, 81, 83, 224, 425/371, 130; 264/113, 91; 162/132, 203, 300, 304, 104

[56] References Cited

U.S. PATENT DOCUMENTS

| | | | |
|---|---|---|---|
| 2,331,145 | 10/1943 | Slayter | 425/83 X |
| 3,737,351 | 6/1973 | Ettel | 425/83 X |

*Primary Examiner*—Richard B. Lazarus
*Attorney, Agent, or Firm*—Larson, Taylor and Hinds

[57] ABSTRACT

An apparatus for forming a multi-ply sheet of paper in which a first web of cellulosic fibers is dry formed and consolidated, a second web of cellulosic fibers is separately dry formed and consolidated, and the two thus consolidated webs are combined into a single multi-ply sheet of paper or paperboard.

3 Claims, 3 Drawing Figures

APPARATUS FOR FORMING MULTI-PLY FIBROUS SHEETS

Figure 1:
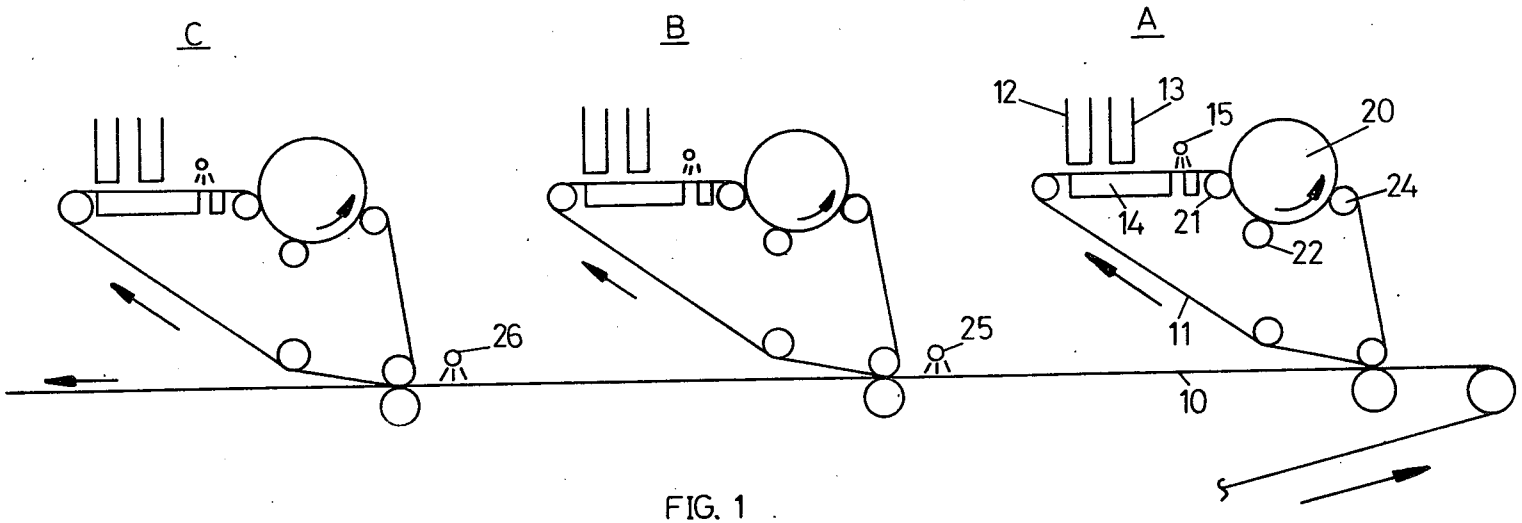

This is a continuation, of application Ser. No. 489,053, filed July 16, 1974, now abandoned, which is in turn a division of U.S. Ser. No. 390,244, filed Aug. 21, 1973 now U.S. Pat. No. 3,905,864.

This invention concerns a method of and apparatus for making multi-ply fibrous sheets or webs and in particular is concerned with the manufacture of fibrous sheets or webs using the so-called dry forming method in which fibres in a substantially dry state are formed into webs and are bound into a sheet using a binder or adhesive rather than or in addition to the conventional wet forming process in which fibres are bonded together by natural hydrogen bonding the web having been cast from prepared stock having a high water content e.g. of the order of 99%.

The advantages of dry paper-forming are well known and it has previously been proposed to form paper sheets or boards of one or two plies by depositing dry fibres onto a supporting surface and bonding these fibres with a binder to form a coherent sheet or web. A single-ply layer is relatively easy to form and a multi-ply sheet consisting of two or perhaps three plies can be formed by depositing the fibres directly on top of the previously formed ply using fibres suspended in a gas stream.

If it is desired to produce folding boxboard, many such plies may be required. For example eight 25gsm. plies could be deposited to make a 200gsm board. The machine can become quite large for so many plies. Furthermore the machine will be even larger if it is desired to place barrier materials between plies since this will space the heads depositing fibres yet further apart. Drying the multi-ply sheet after application of aqueous binders can also be a problem since an otherwise small and compact machine can be rendered large and cumbersome by the need for large diameter driers which are required to dry the whole multiply sheet at once.

The present invention seeks to provide an alternative method of making a multi-ply fibrous sheet or web using the dry paper-making technique and provides a method and apparatus which can be used to form a sheet or web of as many plies as is desired whilst reducing the overall size of the machine and reducing the size of the components e.g. drying cylinders used.

According to one aspect of the present invention there is provided a method of making multi-ply fibrous sheets or webs comprising passing a gas stream containing suspended fibres, through an auxiliary permeable forming surface to form a fibrous layer thereon, and subsequently transferring said fibrous layer onto a main forming surface on which the multi-ply sheet is to be formed.

Preferably the method comprises consolidating the formed fibrous layer on the auxiliary forming surface. This may be done by passing the formed layer with binder through a pressure nip to subject the web to hot moist pressing. The hot moist pressing is preferably effected at a pressure of not less than 50 pounds per square inch and preferably not less than 100 pounds per square inch at a temperature greater than 150° F, preferably greater than 200° F. In a preferred process, the pressure is of the order of 200 pounds per square inch and the temperature of the order of 250° F.

The fibrous layer may be sprayed with a binder following its deposition on said auxiliary permeable forming surface or it may have dry binder mixed therewith and may then be subsequently water sprayed. Yet again the fibres may be impregnated with a binder, dried and used for dry-laying, being subsequently water sprayed.

The method may also comprise applying a vacuum to the face of said auxilliary forming surface remote from that on which the fibres are to be deposited, to urge the fibres into web forming contact therewith.

A plurality of plies of the multi-ply sheet may be formed by the same method and are applied to a common main forming surface. The main forming surface may be an endless band on which the multi-ply sheet is formed and from which it is removed after formation. Alternatively the main forming surface may be a scrim sheet or board to which the fibrous layer is transferred, the scrim sheet or board forming an integral part of the finished product.

The fibrous layers may be applied to opposed sides of the scrim sheet or board and may be adhered thereto by a binder.

The sheet on the main forming surface may be sprayed with further binder before or after each fibrous layer has been deposited thereon, and is subsequently passed through a further pressure nip.

According to another aspect of the present invention there is provided apparatus for making a multi-ply fibrous sheet or web comprising a main forming surface, an auxililary permeable forming surface, means for passing a gas stream containing suspended fibres, through the auxiliary permeable forming surface to form a fibrous layer thereon, and means for transferring said fibrous layer from the auxiliary forming surface to said main forming surface.

A pressure nip or nips may be provided on the auxiliary and/or main forming surface for consolidating the layer by hot wet pressing the web.

The apparatus may include means for spraying binder on said fibrous layer on said auxiliary forming surface and/or on the main forming surface or may include means for adding dry binder to the fibre and subsequently spraying water.

The auxiliary forming surface preferably includes a vacuum box on the face of the surface remote from the source of gas containing suspended fibres.

A preferred embodiment of the present apparatus includes a plurality of ply forming units, an endless common main forming surface on which the multi-ply or coated sheet is formed, and means for removing the finished product from the main forming surface.

The apparatus may however comprise a feed device and reel-up unit for scrim sheet or board which is to form the main forming surface.

Figure 2:
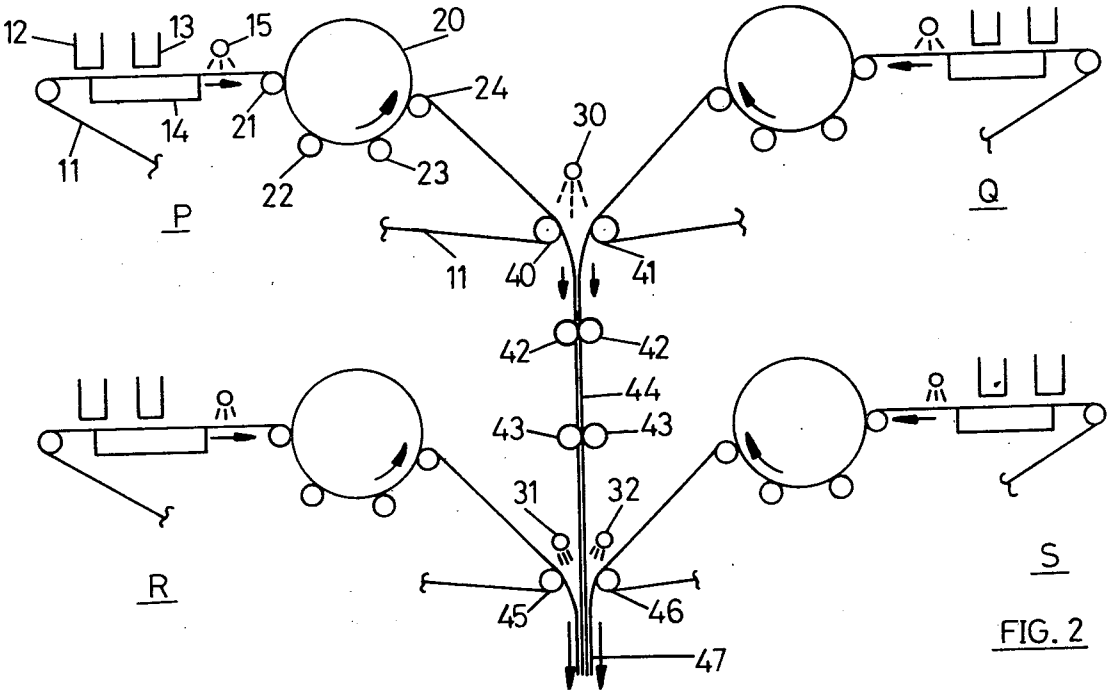
Figure 3:
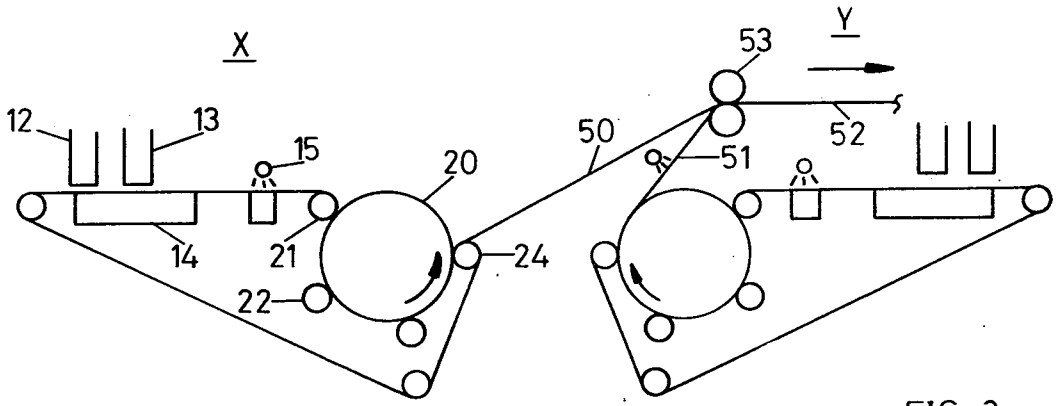

The invention is illustrated merely by way of example in the accompanying drawings in which, FIGS. 1, 2 and 3 are diagrammatic views of three alternative forms of apparatus according to the present invention.

Referring to FIG. 1 apparatus for forming a multi-ply sheet comprises an endless wire or fabric 10 onto which a 150gsm multi-ply sheet is to be formed from three ply stations A, B and C each making a 50gsm web. The stations are identical and only one will be described. Referring to station A this comprises a forming surface in the form of an endless wire 11 movable in the direction of the arrows as shown in the Figure and having an horizontal section passing between fibre dispensing heads 12 and 13 and a vacuum box 14. Dry fibres of 10% moisture content mechanical wood pulp mixed with 4% dry starch are deposited on the wire 11 in an air stream to form a random web of fibre and starch. The web is sprayed with water by sprays 15 to provide a moisture content of 35%. The moist web is consolidated by being subjected to hot pressing by passage around the surface of a steam-heated cylinder 20 of surface temperature 240° F. Two pressure nips are provided by rollers 21 and 22 pressing against cylinder 20 with a pressure of 250 lb/linear inch. The consolidated web is dried as it passes around the cylinder to take-off roll 24 where it has a moisture content of 20–25%. This formed consolidated web is transferred to the wire 10. A vacuum box may be placed below wire 10 to assist in this transfer.

A similar dry laid web is formed in device B and is transferred onto the top of the dry laid web upon wire 10. A vacuum box below wire 10 may assist the transfer. A third dry-laid web is produced in device C and is transferred onto the top of the first two webs to provide a three ply product.

Further binder may be sprayed between the plies by sprays 25 and 26 and further pressure nips can be provided to press these plies into a multi-ply sheet.

The sheet so formed can be treated by size presses and surface spraying in conventional manner to provide the characteristics desired in the final sheet.

It will be appreciated that, with this arrangement much of the moisture added to the fibrous webs has been removed within the forming devices before the webs reach the main forming wire 10.

The present device could be preferable to one in which all 150gsm are deposited in one layer before endeavouring to consolidate and dry the layer since one very large drying cylinder would be required and this could be a disadvantage compared with a number of smaller cylinders. Furthermore the present machine facilitates the use of different furnishes in the plies and the use of different binders, inter-ply agents and barrier properties and more flexibility in weights and production outputs. Differing ply characteristics can of course be achieved by varying the temperature and pressure of each consolidating cylinder in each device A, B, C, whereby sheets of differing strength and/or bulk can be formed. Flexibility of this nature is not so readily available where a single ply, even from a number of heads, is deposited before consolidation and drying.

Referring to FIG. 2 this is similar to FIG. 1 but demonstrates an alternative arrangement in which a bank of ply stations is arranged to provide, in this case, a four-ply sheet.

Four identical devices for forming dry-laid webs are used, identified as P Q R and S. Each device is identical with the devices A B and C of FIG. 1. The parts of device P have been numbered in the same way as the corresponding parts of device A of FIG. 1. A minor difference in device P is the addition of a further pressure roll 23 defining a further pressure nip with cylinder 20.

The process parameters detailed with reference to FIG. 1 are in use in these devices whereby each device P Q R S produces a 50gsm consolidated, dry-laid web of fibres.

The webs from devices P and Q are combined at rolls 40, 41 which press the webs together to form a two ply web 44. Sets of pressure rolls 42, 43 effect further pressing.

The webs from devices R and S are transferred from their respective forming bands onto the opposite surfaces of the two ply web 44 at rolls 45, 46 respectively. A four ply web 47 results from this laminating.

The same details and variations of fibre, binder and process parameters as detailed in FIG. 1 description can be employed here. Thus four 50gsm plies can be formed to provide a 200gsm final sheet. Four pressure nips per cylinder are shown here, each applying 250 lb/linear inch. Water or binder or indeed any solution providing barrier properties may be sprayed between plies by sprays 30, 31, 32.

The weight of each ply on either of the above machines may be from 20 to 100gsm, thereby providing a final sheet of from 60 to 300gsm for a three-ply and from 80 to 400gsm for a four-ply sheet.

A possible disadvantages of the embodiments of FIGS. 1 and 2 for some uses is the existence, on both outer faces of the finished product, of the wire mark or wire surface of the product. Conventionally made products have only one wire side but in the products of FIGS. 1 and 2 both faces will be wire faces.

The disadvantage can be overcome by hot moist pressing the finished product to 'hot roll' or 'iron' the wire marks. An alternative is to hot moist press each ply to 'hot roll' or 'iron' each ply before laminating together. This is done by adding to each consolidating cylinder e.g. 20 a plain heated metal roller which cooperates directly with the surface of cylinder 20 to form a hot plain metal pressure nip. As described in our British application 32098/72 which corresponds to our U.S. Application Ser. No. 375,094, filed June 29, 1973, now abandoned in favor of U.S. Application Ser. No. 708,384, filed July 26, 1976. the wire mark is removed by this technique. Also considerable strength can be developed.

Yet a further arrangement for avoiding wire markings is shown in FIG. 3. In this arrangement, two devices X and Y are employed. Each is identical with device A of FIG 1. Each device produces a 50 gsm dry laid web which is consolidated on the respective cylinders 20. Web 50 is produced on device X. Web 51 is produced on device Y. These webs combine in pressure nip 53 to form a two ply web 52.

This two ply web may pass on to coating and finishing units or may be combined with other similarly formed webs to produce a larger multi-ply web.

With this arrangement, the outer surfaces of the plies will not be wire sides of the web but rather the surfaces formed against the respective heated cylinders 20. The 'wire sides' of each ply will be innermost. The wire mark even on these faces may be reduced or removed by the use of a hot press roll as described above.

The present invention provides a useful alternative method of producing a multi-ply board in which each ply of the board is deposited independently on its own forming wire or surface before being transferred to the main forming surface on which the multi-ply sheet is to be formed. A particular advantage of this is that each ply is dried independently and thus smaller drying cylinders can be used, providing a more compact machine. A further important advantage is that the characteristics of each ply can be determined more readily, since each can be determined before laminating to the next rather than working on the finally formed multi-ply sheet to produce the desired characteristics.

It will be appreciated that many variations on the basic invention set forth above can be effected without departing from the scope of the present invention.

Where particular barrier properties are required, such properties could be produced by extruding a film of plastics material for example polyethylene film between plies. Thus in the embodiment of FIG. 2 a polyethylene extruder could take the place of spray head 30. Indeed such extruders could take the place of each of the heads 30, 31, 32 if particularly complex materials are required.

Rather than spray binder between consecutive plies in the above formation, any other material can be sprayed to provide the final board with rigidity or other properties e.g. fire resistance. Also, particularly when binder is sprayed between the plies, a further pressure nip can be provided between ply stations to further compress the board to form a good coherent sheet.

In the embodiments described above the main forming surface has been an endless wire or fabric from which the final product is removed and reeled-up after formation. In alternative embodiments of the present invention which are not illustrated the main forming surface can be a scrim sheet or board (e.g. wet-laid) onto which the plies or fibrous sheets from the forming stations are deposited to form with the scrim sheet or board an integral product. Thus the supporting surface can be a permeable scrim to which each layer is adhered by binder which is sprayed onto the scrim before each ply station. Alternatively a reel of paper or board which may have been wet-laid can be passed adjacent each forming station to have deposited thereon a fibrous layer which is subsequently sprayed and bonded e.g. to form a flocked or other surface finish to the board or sheet. To coat a sheet or board in this way an unwind device and a reel-up unit will be required for the sheet or board which effectively provides the main forming surface for the new product. Flock or metal fibres or indeed any other fibrous substance can be coated onto a board in this way.

Any suitable fibrous material can be formed into a multi-ply sheets or coated onto another base board by any of the methods described above. In forming a multi-ply sheet or board cellulose fibres could be suspended in air and the binder used could be starch to form a finished multi-ply product similar in properties to that made by conventional paper and board techniques.

With the present invention one is provided with the facility to make and dry efficiently, heavy fibrous sheets. Also in such sheets the plies can be of any fibre and the ply characteristics can be varied readily from ply to ply. Also inter-ply characteristics can be achieved with sprays. A versatile machine is provided for efficient multi-ply sheet production.

What we claim is:

1. Apparatus for forming a multi-ply sheet of paper or paperboard comprising:

means for dry-laying a first web including essentially cellulosic fibers by depositing dry fibers in an air stream onto a movable forming surface, means for applying adhesive or binder to the said dry fibers of the first web, means for adding water to the first web to moisten the same to permit consolidation thereof, means including a pair of rolls defining therebetween a press nip through which the first web passes for simultaneously heating the web to a temperature of at least 150° F and pressing the web to a pressure of at least 50 pounds per square inch, whereby the combination of heat, moisture, binder and pressure cause the first web to consolidate by activation of the adhesive or binder into a consolidated self-sustaining sheet of paper or paperboard, means for dry-laying a second web including essentially cellulosic fibers by depositing dry fibers in an air stream onto a movable forming surface, means for applying adhesive or binder to the said dry fibers of the second web, means for adding water to the second web to moisten the same to permit consolidation thereof, means including a pair of rolls defining therebetween a press nip through which the second web passes for simultaneously heating the web to a temperature of at least 150° F and pressing the web to a pressure of at least 50 pounds per square inch, whereby the combination of heat, moisture, binder and pressure cause the second web to consolidate by activation of the adhesive or binder into a consolidated self-sustaining sheet of paper or paperboard, and means for combining the consolidated self-sustaining first web and the consolidated self-sustaining second web to form a multi-ply sheet of paper or paperboard.

2. Apparatus as claimed in claim 1, further comprising means for supplying water to each of the webs prior to lamination of the two plies to each other.

3. Apparatus as claimed in claim 1, wherein the means for forming the first and second webs includes, respectively, first and second endless forming wires on which are formed the first and second webs respectively, and the means for combining the webs comprises a pair of pressure rolls common to both webs and defining a common pressure nip, the consolidating means for each forming wire being located between the fiber-laying section of the wire and said common nip.

* * * * *